US008585444B2

(12) United States Patent
Chang

(10) Patent No.: US 8,585,444 B2
(45) Date of Patent: Nov. 19, 2013

(54) POWER STRIP DEVICE

(75) Inventor: Hung-Cheng Chang, New Taipei (TW)

(73) Assignee: Wistron Corporation, New Taipei (TW)

( * ) Notice: Subject to any disclaimer, the term of this patent is extended or adjusted under 35 U.S.C. 154(b) by 62 days.

(21) Appl. No.: 13/354,546

(22) Filed: Jan. 20, 2012

(65) Prior Publication Data

US 2012/0289074 A1 Nov. 15, 2012

(30) Foreign Application Priority Data

May 9, 2011 (TW) ..... 100116133 A

(51) Int. Cl.
*H01R 25/00* (2006.01)

(52) U.S. Cl.
USPC ..... 439/651; 439/131; 439/640

(58) Field of Classification Search
USPC ..... 439/640, 131, 650–652, 171
See application file for complete search history.

(56) References Cited

U.S. PATENT DOCUMENTS

| | | | | |
|---|---|---|---|---|
| 6,854,989 | B2 * | 2/2005 | Milan | 439/131 |
| 7,347,734 | B1 * | 3/2008 | Teitelbaum | 439/652 |
| 7,881,034 | B2 * | 2/2011 | Lee et al. | 361/118 |
| 7,972,152 | B1 * | 7/2011 | Wu | 439/131 |
| 8,157,574 | B2 * | 4/2012 | Hsiao | 439/131 |

* cited by examiner

*Primary Examiner* — Hien Vu

(57) ABSTRACT

A power strip device includes a casing and a plurality of socket modules. The casing has a casing body and a plurality of aligned retaining parts formed in the casing body. The socket modules are disposed respectively in the retaining parts. Each of the socket modules has a main body and a socket unit that is formed in the main body. The main body of at least one of the socket modules is movable between a first position to be aligned with the main body of the rest of the socket modules, and a second position to be misaligned with the main body of the rest of the socket modules.

7 Claims, 8 Drawing Sheets

POWER STRIP DEVICE

CROSS-REFERENCE TO RELATED APPLICATION

This application claims priority of Taiwanese Application No. 100116133, filed on May 9, 2011.

BACKGROUND OF THE INVENTION

1. Field of the Invention

The invention relates to an extension cord device, more particularly to an extension cord device serving as a power strip device.

2. Description of the Related Art

As shown in FIG. 1, a conventional power strip device 1 includes a plurality of socket modules 11 for as many plugs to plug in. Each of the socket modules 11 has a fixed position relative to adjacent ones, such that when a larger plug is plugged in one of the socket modules 11, a portion of adjacent socket modules 11 may be blocked by the larger plug, rendering those blocked socket modules 11 unavailable for use.

SUMMARY OF THE INVENTION

Therefore, the object of the present invention is to provide a power strip device that includes socket modules movable with respect to each other for alleviating the aforementioned drawback of the conventional power strip.

Accordingly, a power strip device of the present invention comprises a casing and a plurality of socket modules. The casing has a casing body and a plurality of retaining parts that are formed in the casing body and that are aligned in a first direction. The socket modules are disposed respectively in the retaining parts. Each of the socket modules has a main body and a socket unit that is formed in the main body. The main body of at least one of the socket modules is movable between a first position and a second position in a second direction that is transverse to the first direction. The socket unit of the at least one of the socket modules is aligned with the socket unit of each of the rest of the socket modules in the first direction when the main body of the at least one of the socket modules is at the first position. The socket unit of the at least one of the socket modules is misaligned with the socket unit of each of the rest of the socket modules in the first direction when the main body of the at least one of the socket modules is at the second position.

BRIEF DESCRIPTION OF THE DRAWINGS

Other features and advantages of the present invention will become apparent in the following detailed description of the embodiments with reference to the accompanying drawings, of which.

DETAILED DESCRIPTION OF THE EMBODIMENTS

Figure 1:
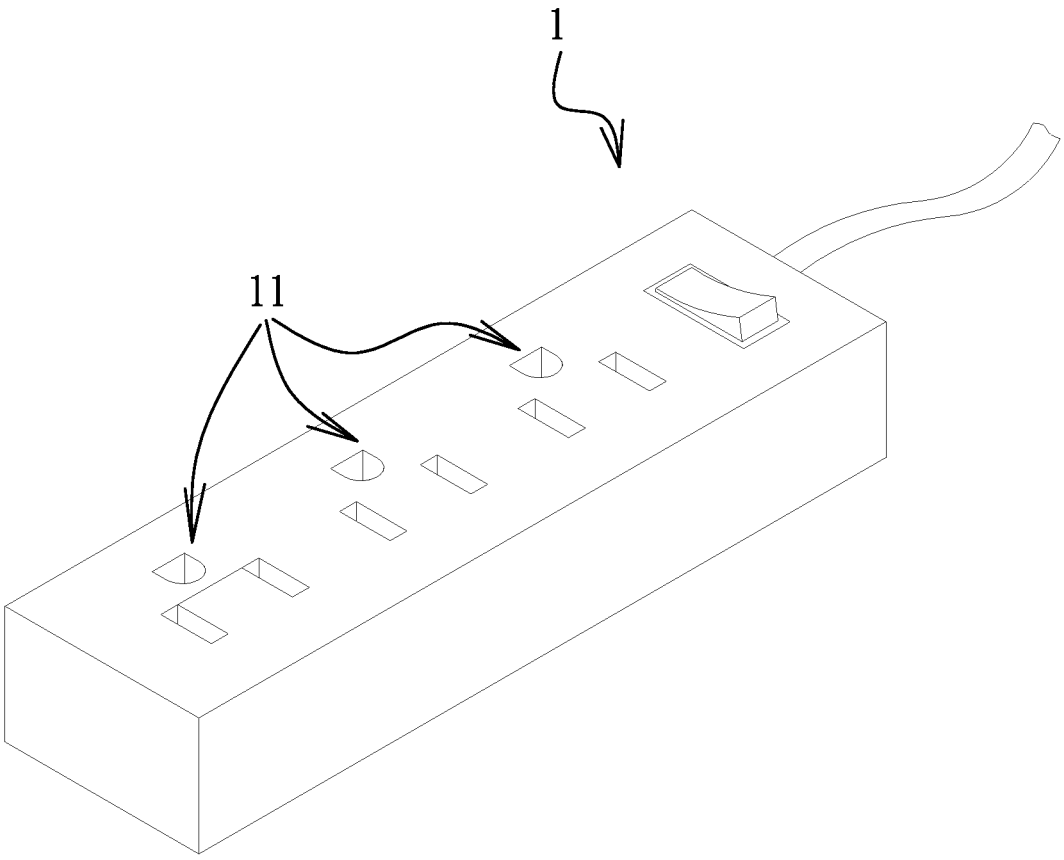
F I G. 1 PRIOR ART
FIG. 1 is a fragmentary perspective view of a conventional power strip device.

Before the present invention is described in greater detail, it should be noted that like elements are denoted by the same reference numerals throughout the disclosure.

Figure 2:
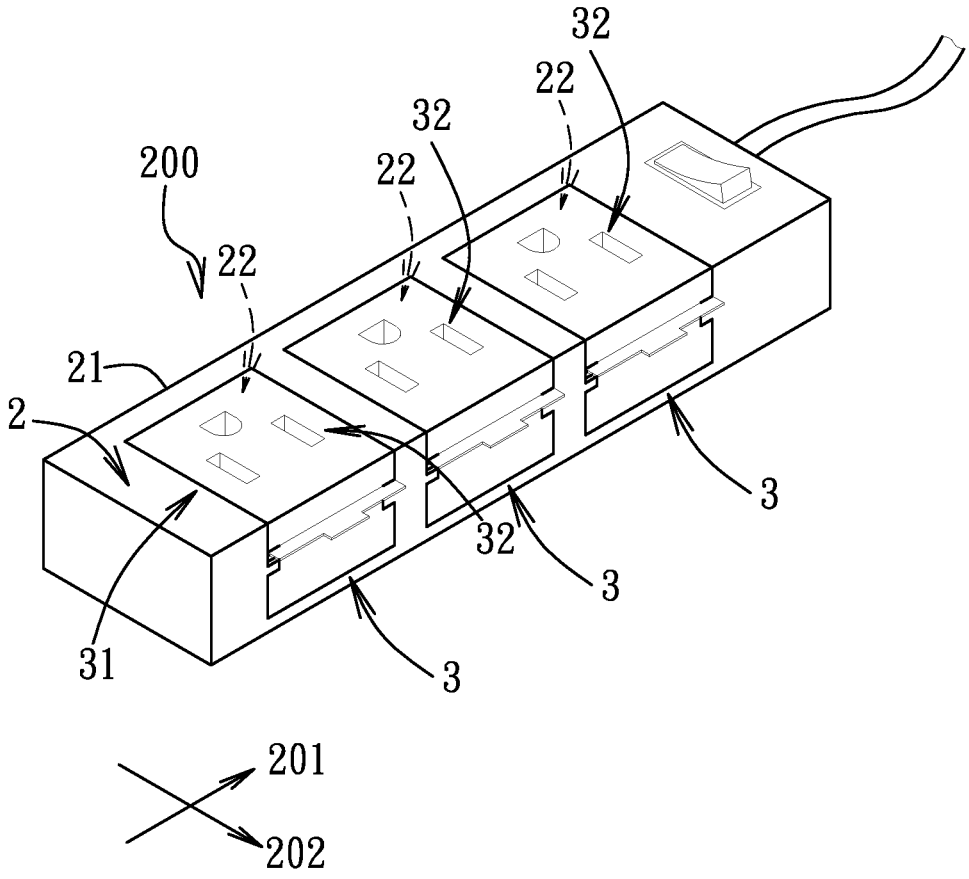
FIG. 2 is a fragmentary perspective view of a first embodiment of a power strip device according to the invention, illustrating again body of a socket module at a first position.
Figure 3:
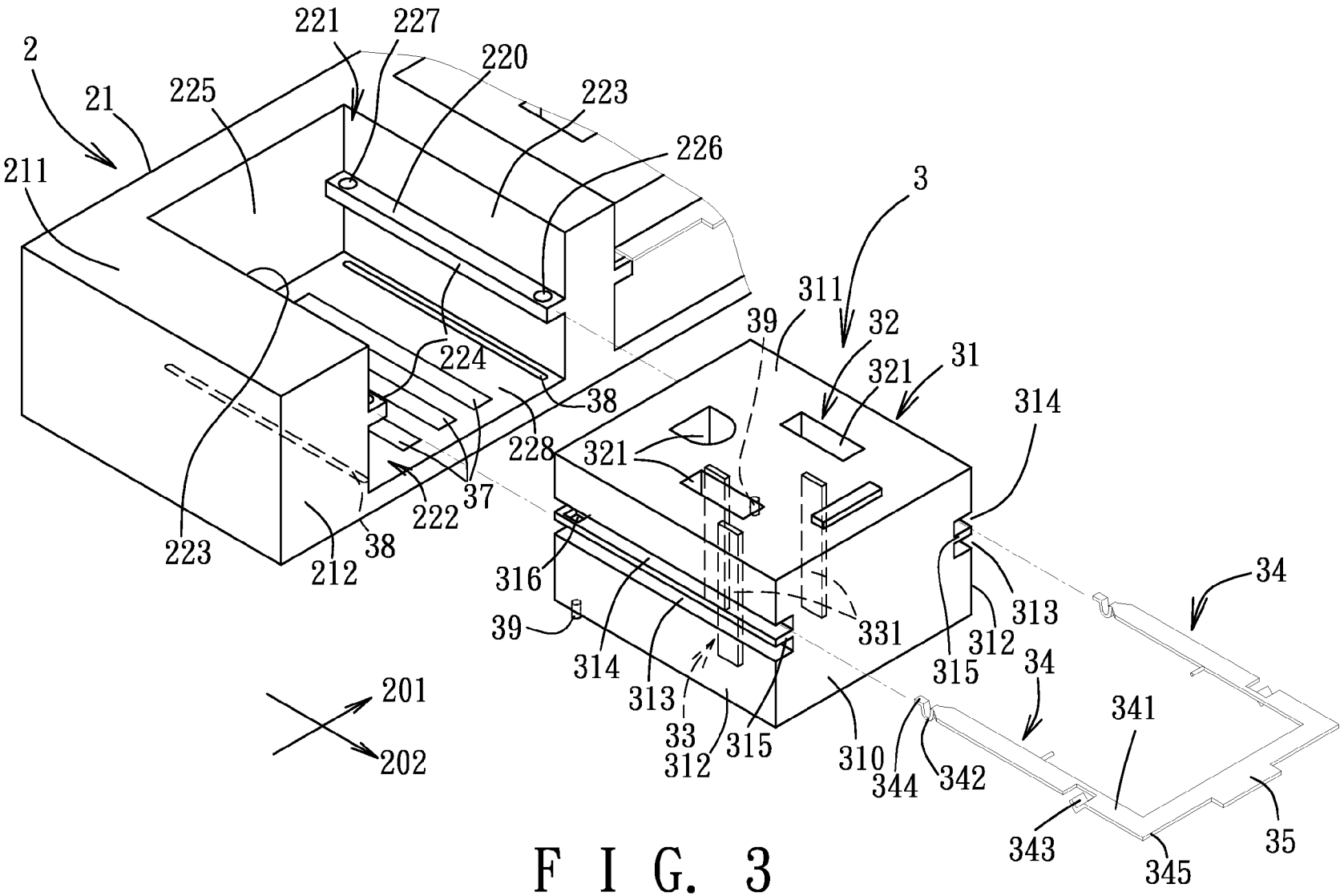
FIG. 3 is a fragmentary exploded perspective view of the first embodiment.
Figure 4:
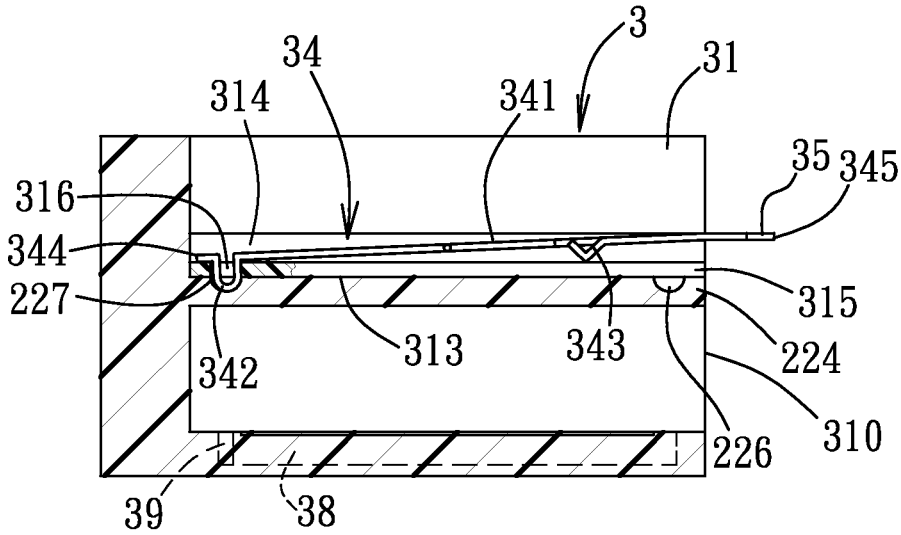
FIG. 4 is a sectional view of the main body of the socket module of the first embodiment at the first position.

As shown in FIGS. 2 to 4, the first embodiment of a power strip device 200 according to the present invention comprises a casing 2 and a plurality of socket modules 3.

The casing 2 has a casing body 21 and a plurality of retaining parts 22 that are formed in the casing body 21 and that are aligned in a first direction 201. The casing body 21 has a top wall 211 at a top side thereof and a lateral wall 212 at a lateral side thereof. In this embodiment, each of the retaining parts 22 has a top opening 221 formed in the top wall 211 of the casing body 21, and a lateral opening 222 formed in the lateral wall 212 of the casing body 21. Each of the retaining parts 22 has a pair of inner surfaces 223 spaced apart from each other in the first direction 201 and facing each other, a bottom surface 228 interconnecting the inner surfaces 223, and a pair of guide ribs 224 formed respectively on the inner surfaces 223. The inner surfaces 223 and the bottom surface 228 of each of the retaining parts 22 cooperate with one another to define a retaining space 225 thereamong. Each of the guide ribs 224 extends in a second direction 202 that is transverse to the first direction 201, and has opposite ends proximate to and distal from the lateral opening 222, respectively. Each of the guide ribs 224 has a top surface 220 formed with a first positioning hole 226 and a second positioning hole 227 that are respectively proximate to and distal from the corresponding lateral opening 222.

The socket modules 3 are disposed respectively in the retaining parts 22 of the casing 2. In this embodiment, each of the socket modules 3 has a main body 31, a socket unit 32 that is formed in the main body 31, and a conductive plate unit 33 disposed in the main body 31. The main body 31 may be made of plastic, and has an upper surface 311, a pair of first outer surfaces 312 spaced apart from each other in the first direction 201, and a second outer surface 310. Each of the first outer surfaces 312 is formed with a guide grooves 313 extending in the second direction 202, a retaining groove 314 located above and parallel with the two guide groove 313, and a rib member 315 that is disposed respectively between the retaining groove 314 and the guide groove 313 and that is formed with a connecting hole 316 at a position distal from the second outer surface 310 and communicating spatially the retaining groove 314 and the guide groove 313. The function of the connecting holes 316 will be described in the succeeding paragraphs.

For each of the socket modules 3, the socket unit 32 is disposed in the upper surface 311 of the main body 31, and has a plurality of socket holes 321. The conductive plate unit 33 is disposed in the main body 31, and includes a plurality of conductive plates 331 registered respectively with the socket holes 321.

For each of the socket modules 3, when the main body 31 is retained in the retaining space 225 of the corresponding retaining part 22, the socket unit 32 is exposed from the top opening 221 of the top surface 211, the first outer surfaces 312 face respectively the inner surfaces 223 of the corresponding retaining parts 22, and the guide ribs 224 of the inner surfaces 223 of the corresponding retaining parts 22 engage respectively the guide grooves 313. The main body 31 is thus disposed slidably between the inner surfaces 223 and is permitted to slide out of the retaining space 225 through the lateral opening 222.

Each of the socket modules 3 further has two engaging members 34 engaging the retaining grooves 314, and a press plate 35. Each of the engaging members 34 has an arm part 341, an engaging part 342 and an elastic structure 343. The arm part 341 has opposite first and second ends 344, 345. The engaging part 342 protrudes downwardly from the arm part 341 at a position adjacent to the first end 344. The elastic structure 343 protrudes downwardly from the arm part 341 at a position adjacent to the second end 345. In this embodiment, each of the engaging part 342 and the elastic structure 343 of the engaging members 34 is a substantially V-shaped or U-shaped structure formed by stamping a segment of the arm part 341 of a corresponding one of the engaging members 34.

Figure 5:
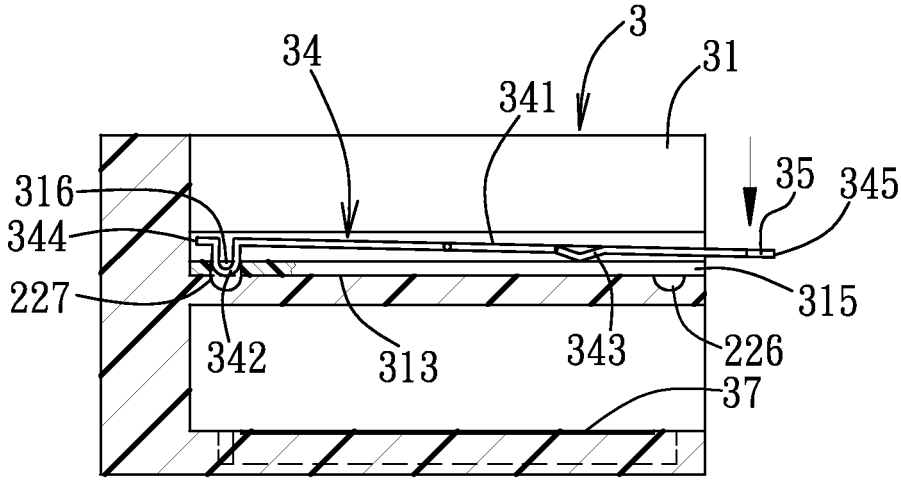
FIG. 5 is a view similar to FIG. 4, but illustrating an operation of an engaging member for releasing the main body of the socket module from the first position.

Further referring to FIG. 5, for each of the engaging members 34, when engaging the corresponding one of the retaining grooves 314, the arm part 341 is pivoted to the main body 31 of the corresponding socket module 3, the elastic structure 343 abuts resiliently against the corresponding rib member 315, and the engaging part 342 is disposed to correspond in position to the connecting hole 316 of the corresponding rib member 315. Due to the abutment of the elastic structure 343 against the corresponding rib member 315, the second end 345 is located higher than the first end 344 (see FIG. 4), and the engaging part 342 engages the connecting hole 316 of the corresponding rib member 315 and extends into the corresponding guide groove 313 at a normal state without exterior force.

For each of the socket modules 3, the press plate 35 interconnects the second ends 345 of the arm parts 341 of the engaging members 34 (i.e., the press plate 35 cooperates with the engaging members 34 to form a substantially U-shaped structure), and is adjacent to the second outer surface 310 of the main body 310. The press plate 35 and the engaging members 34 may be integrally formed into the substantially U-shaped structure. As shown in FIG. 5, when the press plate 35 is pressed such that a downward force is applied to the second ends 345 of the arm parts 341, the elastic structures 343 deform and serve as fulcrums of the pivot action of the arm parts 341, and the engaging parts 342 are moved upwardly to be disengaged from the guide grooves 313. When the force pressing the press plate 35 is released, the restoring force of the elastic structures 343 drives the engaging members 34 back to the normal state with the second ends 345 of the arm parts 341 moving upwardly and the engaging parts 342 moving downwardly back into the corresponding guide grooves 313.

FIG. 2 shows the power strip device 200 at a general state. At this state, the socket modules 3 are disposed respectively in the retaining parts 22, and each of the socket modules 3 is at a first position, where the socket units 32 of the socket modules 3 are aligned in the first direction 201, and where the engaging parts 342 of the engaging members 34 engage respectively the second positioning holes 227 of the guide ribs 224 on the respective one of the retaining parts 22 (see FIG. 4).

Figure 6:
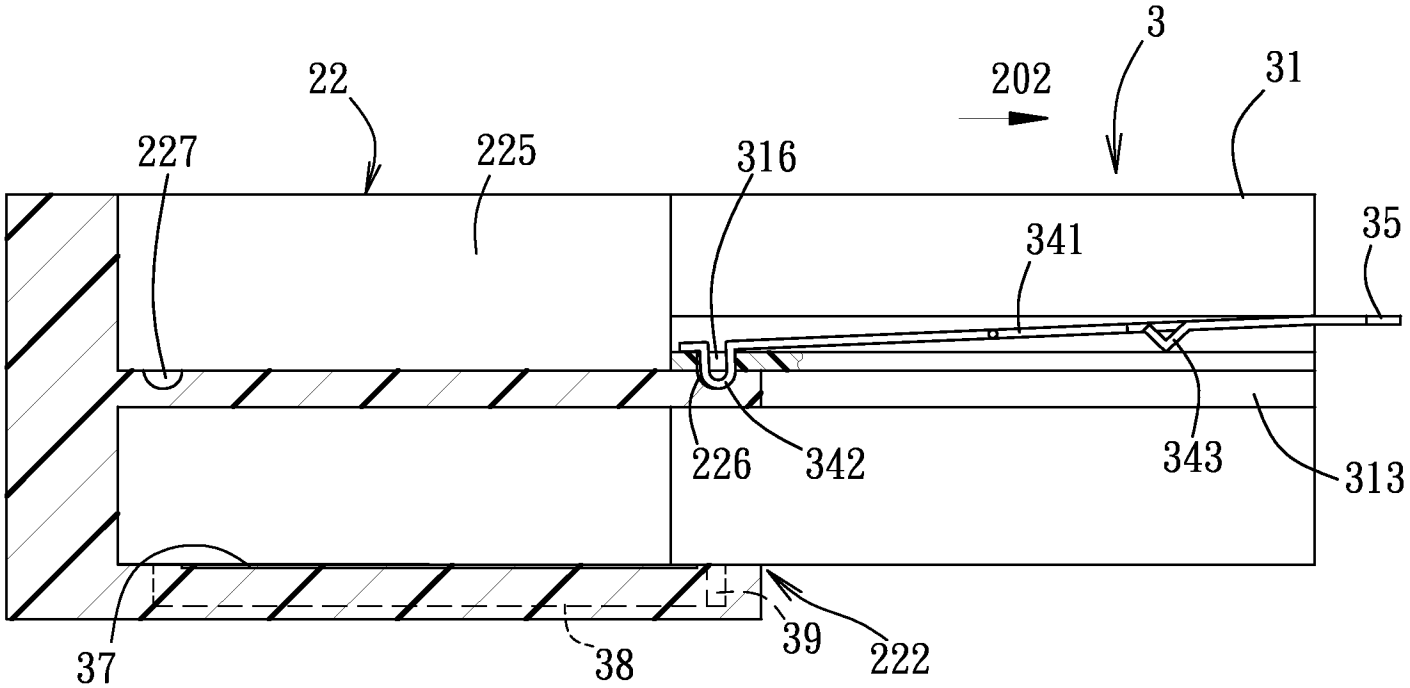
FIG. 6 is another sectional view of the main body of the socket module of the first embodiment located at a second position.
Figure 7:
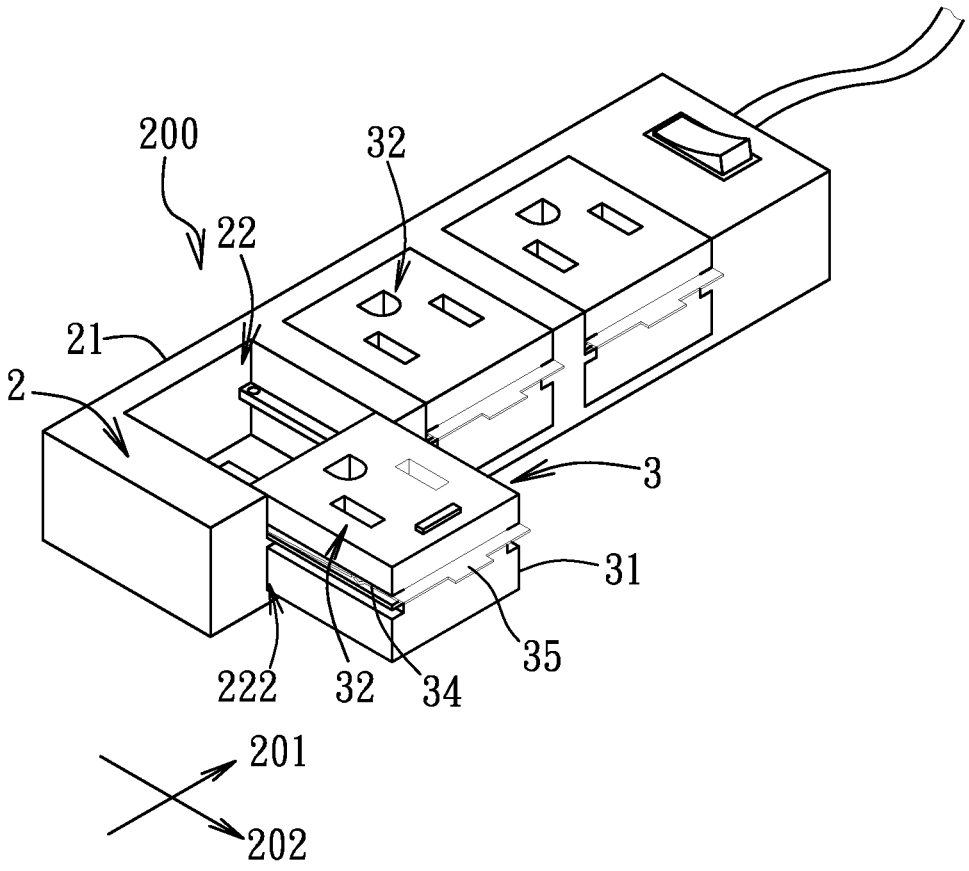
FIG. 7 is another fragmentary perspective view of the socket module of the first embodiment illustrating the main body of the socket module at a second position.

Further referring to FIGS. 5 to 7, when one of the socket modules 3 needs to contact a relatively large plug, the press plate 35 of the one of the socket modules 3 is pressed to bring the engaging parts 342 of the corresponding engaging members 34 out of the corresponding second positioning holes 227, thereby disengaging the one of the socket modules 3 from the corresponding retaining part 22. As shown in FIG. 6, the main body 31 of the one of the socket modules 3 is subsequently moved out of the corresponding retaining space 225 through the corresponding lateral opening 222 in the second direction 202 to a second position, where the engaging parts 342 of the engaging members 34 engage respectively the first positioning holes 226, and where the socket unit 32 of the one of the socket modules 3 is misaligned with the socket units 32 of the rest of the socket modules 3 in the first direction 201 (see FIG. 7), thereby providing more space between the one of the socket modules 3 and the rest of the socket modules 3. The larger plug is therefore able to plug into the one of the socket modules 3 without blocking other socket modules 3.

On the contrary, when the one of the socket modules 3 is not in use for the relatively large plug, the press plate 35 of the one of the socket modules 3 is pressed once again to move the engaging parts 342 of the engaging members 34 out of the first positioning holes 226 and disengage the one of the socket modules 3 from the retaining part 22. The one of the socket modules 3 pushed back into the retaining space 225 until the engaging parts 342 of the engaging members 34 engage respectively the second positioning holes 227, namely, the main body 31 of the one of the socket modules 3 is moved back to the first position.

It should be noted that, while this invention is exemplified using the configuration that the main bodies 31 of all the socket modules 3 are movable between the first and second positions, the power strip device 200 may also be configured such that not all, but at least one of the socket modules 3 is movable in other embodiments of this invention.

Referring back to FIG. 3, the conductive plates 331 of the conductive plate units 33 are electrically connected with each other. This may be done by using electrical wires to connect physically the conductive plates 331 together, or by configuring each of the conductive plate units 33 to be exposed from the bottom of the main body 31 of the corresponding socket unit 3, and disposing electrode plate units 37 on the bottom surfaces 228 of the retaining parts 22, respectively. Each of the electrode plate units 37 extends in the second direction 202 such that each of the conductive plate units 33 of the socket modules 3 is constantly in electrical contact with the corresponding electrode plate unit 37 during movement of the corresponding socket module 3 in the second direction 202.

Moreover, for each socket module 3, in order to prevent the socket module 3 from being detached from the casing body 21 during the movement in the second direction 202, a pair of slide grooves 38 and a pair of slide axles 39 can be formed respectively on the bottom surface 228 of the retaining part 22 and a bottom side of the main body 31. The slide axles 39 engage slidably and respectively the slide grooves 38. The slide grooves 38 extend in the second direction 202 but do not extend to the lateral wall 212 of the casing body 21 so as to inhibit the movement of the socket modules 3 beyond the casing body 21. The slide axles 39 may even be configured to protrude resiliently from the bottom side of the main body 31 and can be retracted when the main body 31 slides in the second direction 202 into the retaining part 22, thereby facilitating the coupling of the socket module 3 to the retaining part 22.

Additionally, for each socket module 3, with an appropriate arrangement of the engaging members 34 and the corresponding first and second positioning holes 226, 227, the locations of the guide grooves 313 and the corresponding guide ribs 224 may be interchanged, i.e., the guide grooves 313 may be formed respectively in the inner surfaces 223 of the corresponding one of the retaining parts 22, and the corresponding guide ribs 224 may be formed respectively on the first outer surfaces 312 of the main body 31 of the socket modules 3.

Figure 8:
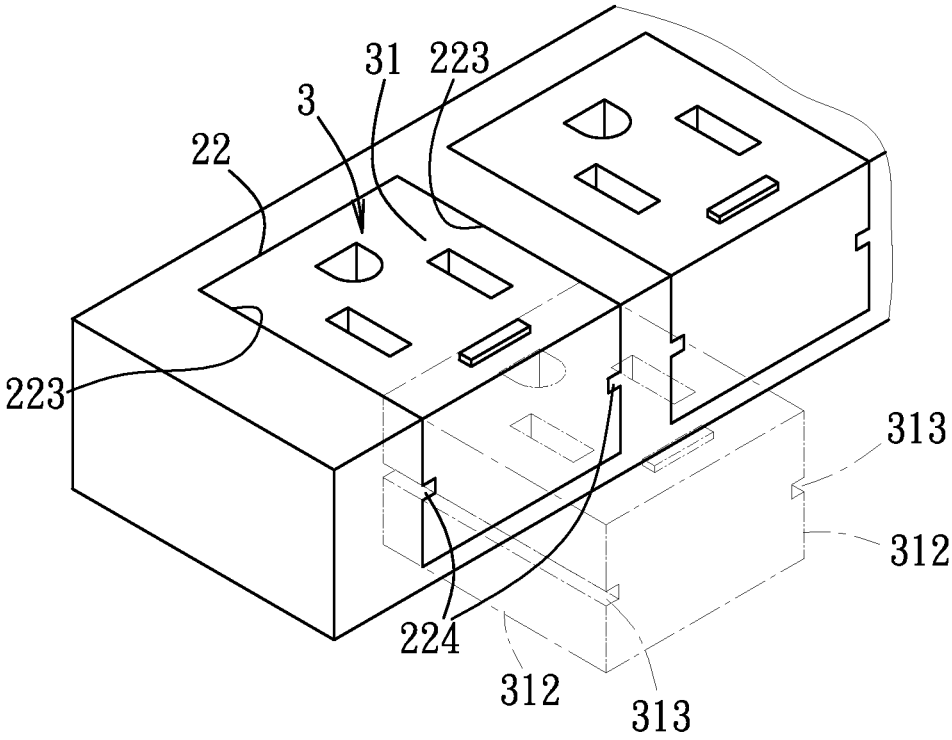
FIG. 8 is a fragmentary perspective view of a second embodiment of a power strip device according to the invention.
Figure 9:
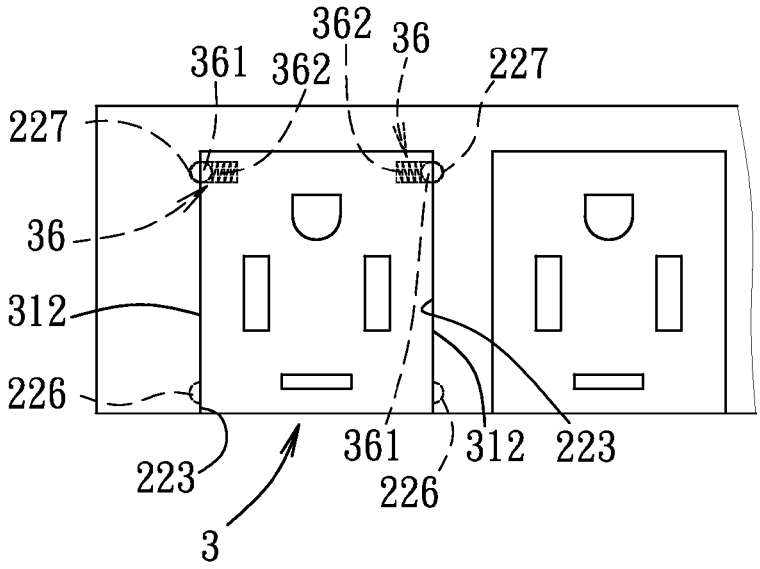
FIG. 9 is a fragmentary schematic top view of the second embodiment illustrating the main body of the socket module at the first position.
Figure 10:
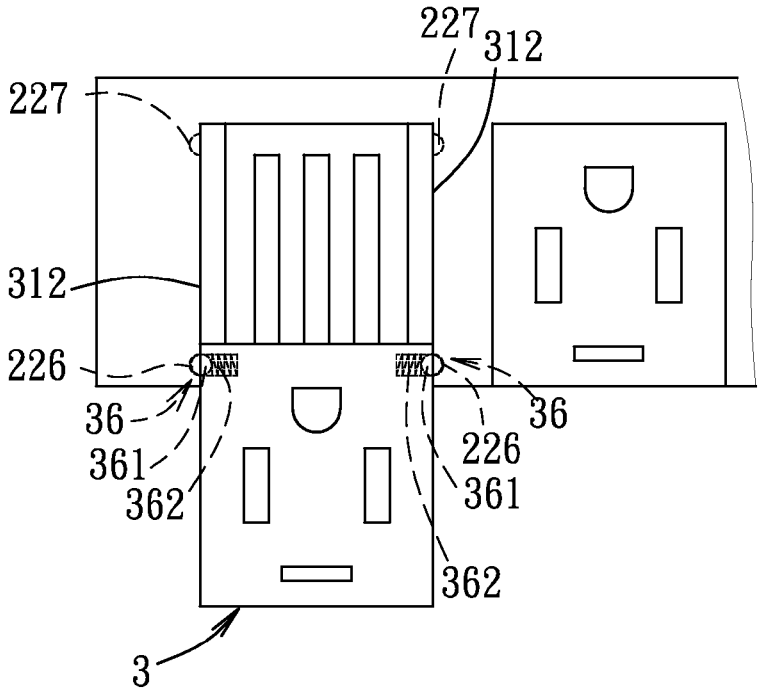
FIG. 10 is another fragmentary schematic top view of the second embodiment illustrating the main body of the socket module at the second position.

As shown in FIGS. 8 to 10, the second embodiment of the power strip device 200 according to the present invention has a structure similar to that of the first embodiment. The main difference between this embodiment and the previous embodiment resides in the following. The inner surfaces 223 of each of the retaining parts 22 are only formed respectively with the pair of guide ribs 224, and the first outer surfaces 312 of each of the socket modules 3 are only formed with the two guide grooves 313 engaged respectively with the guide ribs 224 of the corresponding one of the retaining parts 22 so as to permit the movement of the main body 31 of each of the socket modules 3 in the second direction 202. Each of the inner surfaces 223 is formed with the first positioning hole 226 and the second positioning hole 227. The first and second positioning holes 226 and 227 are aligned with each other in the second direction 202. Each of the socket modules 3 has two engaging members 36 that are disposed on, and that protrude respectively and resiliently from the first outer surfaces 312 of the main body 31. Each of the engaging members 36 includes an engaging body 361 that protrudes partly from a respective one of the first outer surfaces 312 of the main body 31, and a resilient member 362 disposed in the main body 31 and abutting against the engaging body 361. The engaging body 361 of each engaging member 36 can retract entirely into the main body 31 during movement of the socket module 3 between the first and the second positions, and protrudes from the first outer surface 312 to engage the corresponding first or second positioning holes 226, 227 when registered with the corresponding first or second positioning hole 226, 227.

In this embodiment, the locations of the guide grooves 313 and the guide ribs 224 may also be interchanged, i.e., the guide grooves 313 may be formed respectively in the inner surfaces 223 of the corresponding one of the retaining parts 22, and the guide ribs 224 may be formed respectively on the first outer surfaces 312 of the main body 31 of the socket modules 3. Moreover, for each socket module 3 and the corresponding retaining part 22, the mechanism of the slide grooves 38 and the slide axles 39 as illustrated in FIG. 3 can be optionally provided thereto in order to prevent the socket module 3 from being detached from the casing body 21.

To sum up, each of the socket modules 3 in this invention is configured to be movable with respect to the casing body 21 so as to be misaligned with the rest of the socket modules 3, and is therefore able to contact a relatively large plug without blocking adjacent socket modules 3. Various forms of engaging members 34 and 36 are also provided for cooperating with the first and second positioning holes 226 and 227 to retain the socket modules 3 at the first and second positions.

While the present invention has been described in connection with what are considered the most practical embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A power strip device comprising:

a casing having a casing body and a plurality of retaining parts that are formed in said casing body and that are aligned in a first direction; and a plurality of socket modules disposed respectively in said retaining parts, each of said socket modules having a main body and a socket unit that is formed in said main body, said main body of at least one of said socket modules being movable between a first position and a second position in a second direction that is transverse to the first direction, said socket unit of the at least one of said socket modules being aligned with said socket unit of each of the rest of said socket modules in the first direction when said main body of the at least one of said socket modules is at the first position, said socket unit of the at least one of said socket modules being misaligned with said socket unit of each of the rest of said socket modules in the first direction when said main body of the at least one of said socket modules is at the second position;

wherein said main body of the at least one of said socket modules has a pair of first outer surfaces spaced apart from each other in the first direction;

wherein a respective one of said retaining parts has a pair of inner surfaces facing respectively said first outer surfaces of the at least one of said socket modules when said main body of the at least one of said socket modules is at the first position; and wherein one of said pairs of said first outer surfaces of the at least one of said socket modules and said inner surfaces of the respective one of said retaining parts are formed respectively with a pair of guide ribs extending in the second direction, and the other one of said pairs of said first outer surfaces of said main body of the at least one of said socket modules and said inner surfaces of the respective one of said retaining parts are formed respectively with two guide grooves engaged respectively with said guide ribs so as to permit the movement of said main body of the at least one of said socket modules in the second direction.

2. The power strip as claimed in claim 1, wherein:

the respective one of said retaining parts has a lateral opening formed in a lateral side of said casing body;

each of said guide ribs is formed with a first positioning hole and a second positioning hole that are respectively proximate to and distal from said lateral opening; and the at least one of said socket modules further has two engaging members engaging respectively said second positioning holes of said guide ribs when said main body of the at least one of said socket modules is at the first position, and engaging respectively said first positioning holes when said main body of the at least one of said socket modules is at the second position.

3. The power strip device as claimed in claim 2, wherein:

said guide grooves are formed respectively in said first outer surfaces of said main body of the at least one of said socket modules, and said guide ribs are formed respectively on said inner surfaces of the respective one of said retaining parts;

each of said first outer surfaces of said main body of the at least one of said socket modules is further formed with a retaining groove and a rib member that is disposed between said retaining groove and said guide groove and that is formed with a connecting hole communicating spatially said retaining groove and said guide groove;

said engaging members are retained in said retaining grooves of said first outer surfaces of said main body of the at least one of said socket modules, respectively;

each of said engaging members has an arm part that is pivoted to said main body of the at least one of said socket modules and that has opposite first and second ends, an engaging part that protrudes from said arm part at a position adjacent to said first end and that engages said connecting hole of said rib member on a respective one of said first outer surfaces, and an elastic structure that protrudes from said arm part at a position adjacent to said second end and that abuts resiliently against said rib member on the respective one of said first outer surfaces; and when said main body of the at least one of said socket modules is at the first position, said engaging parts of said engaging members engage respectively said second positioning holes of said guide ribs on the respective one of said retaining parts, and when said main body of the at least one of said socket modules is at the second position, said engaging parts of said engaging members engage respectively said first positioning holes of said guide ribs on the respective one of said retaining parts.

4. The power strip device as claimed in claim 3, wherein said elastic structure of each of said engaging members is a substantially V-shaped structure formed by stamping a segment of said arm part of a corresponding one of said engaging members.

5. The power strip device as claimed in claim 3, wherein said main body of the at least one of said socket modules further has a second outer surface formed with said lateral opening, the at least one of said socket modules further including a press plate that interconnects said second ends of said arm parts of said engaging members and that is adjacent to said second outer surface of said main body.

6. The power strip device as claimed in claim 1, wherein the at least one of said socket modules further has two engaging members that are disposed on said main body and that protrude respectively and resiliently from said first outer surfaces of said main body, each of said inner surface of the respective one of said retaining parts being formed with a first positioning hole and a second positioning hole that are aligned with each other in the second direction, said engaging members engaging respectively said second positioning holes on the respective one of said retaining parts when said main body of the at least one of said socket modules is at the first position, said engaging members engaging respectively said first positioning holes on the respective one of said retaining parts when said main body of the at least one of said socket modules is at the second position.

7. The power strip device as claimed in claim 6, wherein each of said engaging members includes an engaging body that protrudes partly from a respective one of said first outer surfaces of said main body of the at least one of said socket modules, and a resilient member disposed in said main body of the at least one of said socket modules and abutting against said engaging body.

* * * * *